United States Patent [19]

Cady et al.

[11] Patent Number: 4,481,048

[45] Date of Patent: Nov. 6, 1984

[54] EXPLOSIVE DOUBLE SALTS AND PREPARATION

[75] Inventors: Howard H. Cady; Kien-yin Lee, both of Los Alamos, N. Mex.

[73] Assignee: The United States of America as represented by the United States Department of Energy, Washington, D.C.

[21] Appl. No.: 345,460

[22] Filed: Feb. 3, 1982

[51] Int. Cl.[3] ..... C06B 31/32

[52] U.S. Cl. ..... 149/47; 149/92; 564/512

[58] Field of Search ..... 149/47, 92, 109.6; 564/512

[56] References Cited

U.S. PATENT DOCUMENTS

| | | | |
|---|---|---|---|
| 1,968,158 | 7/1934 | Naoûm et al. | 149/47 |
| 3,110,639 | 11/1963 | Clark et al. | 149/47 |
| 4,110,136 | 8/1978 | Hershkowitz et al. | 149/47 |
| 4,300,962 | 11/1981 | Stinecipher et al. | 149/47 |
| 4,353,758 | 10/1982 | Akst et al. | 149/47 |

FOREIGN PATENT DOCUMENTS

| | | | |
|---|---|---|---|
| 384966 | 12/1932 | United Kingdom | 149/47 |

*Primary Examiner*—Edward A. Miller

*Attorney, Agent, or Firm*—Lee W. Huffman; Paul D. Gaetjens; Michael F. Esposito

[57] ABSTRACT

Applicants have discovered a new composition of matter which is an explosive addition compound of ammonium nitrate (AN) and diethylenetriamine trinitrate (DETN) in a 50:50 molar ratio. The compound is stable over extended periods of time only at temperatures higher than 46° C., decomposing to a fine-grained eutectic mixture (which is also believed to be new) of AN and DETN at temperatures lower than 46° C. The compound of the invention has an x-ray density of 1.61 g/cm$^3$, explodes to form essentially only gaseous products, has higher detonation properties (i.e., detonation velocity and pressure) than those of any mechanical mixture having the same density and composition as the compound of the invention, is a quite insensitive explosive material, can be cast at temperatures attainable by high pressure steam, and is prepared from inexpensive ingredients. Methods of preparing the compound of the invention and the fine-grained eutectic composition of the invention are given.

3 Claims, 5 Drawing Figures

EXPLOSIVE DOUBLE SALTS AND PREPARATION

BACKGROUND OF THE INVENTION

The present invention relates generally to explosive materials and to methods of preparing such materials and relates more particularly to explosive double salts and to their preparation. This invention is a result of a contract with the Department of Energy (Contract No. W-7405-ENG-36).

A double salt is a salt made up of two different types of cations and one type of anion or of two different types of anions and one type of cation.

In research on explosive materials, mixtures of various materials have been made, melted, and recrystallized. Such study of eutectic mixtures (i.e., mixtures wherein the molten phases are miscible, but the solids are immiscible) has been done in order to try to obtain very intimate mixtures of materials. It is well known in the art area of explosives that when the grain size of a eutectic composition of oxidizer and fuel A is finer than that of a eutectic B with similar chemical composition, the energy release in a detonation of A will be faster than in a detonation of B because mixing of the oxidizer and fuel will occur in a shorter period of time. When a eutectic is crystallized from a melt, better mixing of the ingredients of the eutectic is possible than can be obtained by grinding and mixing the powders which were used to form the eutectic. Additionally, crystallizing a eutectic is often safer than grinding and mixing together powders which are explosive.

A large variety of materials have been mixed together in attempts to find good eutectic compositions. This has included work in which ammonium nitrate (hereinafter referred to as AN) and diethylenetriamine trinitrate (hereinafter referred to as DETN) were mixed and melted together in an attempt to find a good eutectic. However, applicants do not know of any discovery by others of any compound formed between AN and DETN or between AN and any other fuel which contains only carbon, hydrogen, nitrogen, and oxygen.

Conventional military explosives such as TNT have the oxidizer and fuel combined in one molecule, assuring very short diffusion distances for the chemical reaction that drives the detonation. The same benefit would be true of an explosive in which the oxidizer and fuel were separate molecules but which combine to form a crystalline compound. Ammonium nitrate is such a compound, but it has the disadvantage of having an excess of oxidizing power. Other nitrate salts have also been used as explosives, but they have had an excess of fuel or other disadvantages that preclude their use. It would be very desirable to obtain a compound with oxidizer/fuel ratio that is nearly equal to one.

Therefore, there has been an extended search for such explosive compounds. For approximately fifty years, this search has gone on for an explosive double salt compound with a near unity oxidizer/fuel ratio because it would have more explosive potential than would a mechanical mixture of the same ingredients used to form the compound. An especially desired goal has been to find an explosive double salt which will have essentially only gaseous products when it explodes because solid products detract from the power of the explosive and its ability to do work.

However, despite this fifty-year search, such a material until now has not been discovered.

SUMMARY OF THE INVENTION

Objects of this invention are a double salt having explosive properties and forming essentially gaseous products upon exploding, as well as a method of preparing such a compound.

Other objects of this invention are a very fine-grained eutectic composition (of which the grain is finer than the grain of any previously known eutectic of the materials forming the eutectic composition), as well as a method of preparing such a fine-grained eutectic.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the composition of matter of this invention comprises a double salt compound which is a 50:50 molar percent addition compound of AN and DETN. The compound was determined to have the formula $$NH_4^{30}.[(NH_3CH_2CH_2)_2NH_2]^{+3}.(NO_3^{31})_4.$$

This compound is fully characterized by (i.e., can be identified by) its X-ray diffraction pattern and its phase diagram, as described below. The actual molar ratio of AN:DETN in the compound may differ slightly from a 50:50 molar ratio (perhaps up to a few percent) because of solid solution effects and crystalline defects.

Throughout this application it should be understood that the temperatures given for the spontaneous or rapid growth of the compound are not based on thermodynamics but are temperatures at which an experienced practitioner will observe the experimental results indicated in this application in a reasonable period of time. When time is unlimited, the same result should be observed wherever the compound is stable (as shown in FIG. 2). Temperatures which are not based on thermodynamics will be prefaced by "about" because of the possibility of a range around the given temperature. Thermodynamic temperatures are given as measured, but it should be understood that they may also have experimental errors. We have no reason to believe that the thermometers used have errors larger than 1° C.

The present invention also comprises, in accordance with its objects and purposes, a method for preparing in essentially pure form the new composition of matter described above, said method comprising: (a) mixing AN and DETN in a relative molar ratio of about 50:50; (b) heating the mixture so that its eutectic melts; and (c) maintaining the temperature of the melt below 124° C. but higher than the temperature of eutectic melting for a period of time sufficient to enable the compound to form. Addition of seeds of the compound ensures the rapid conversion of melt to solid. Thereafter, the temperature of the compound must be maintained above 46° C. to prevent its slow dissociation back into AN and DETN. However, when the molar ratio of AN:DETN in step (a) above is 65:35 and when the temperature in step (c) above is maintained above about 110° C. (the temperature on the liquidus line for the mixture) but below the temperature on the liquidus line corresponding to that composition for the compound then the thermodynamics and kinetics of recrystallization from the melt both appear to be appropriate so that the compound will form most easily and will be as visually distinct as possible from crystalline DETN. Once the compound is prepared, crystals of the compound can be used as seed crystals to produce large quantities of the compound.

The present invention also comprises, in accordance with its objects and purposes, a very fine-grained eutectic (finer than any previously known eutectic of AN and DETN), which forms when the compound of the invention dissociates. This dissociation occurs when the temperature of the compound is allowed to fall below 46° C. The resulting decomposition product itself has useful explosive properties and is believed to be new and unobvious due to its very fine grain size. The fine grain size results from recrystallization from a solid phase, instead of the normal eutectic crystallization from a melt.

The present invention also comprises, in accordance with its objects and purposes, a method of producing the fine-grained eutectic described above, the method comprising allowing the temperature of the compound of the invention to fall below 46° C.

The compound of the invention exhibits the following significant advantages. When it explodes, the products of the explosion are essentially all gaseous. This is very important because this property results in greater ability to do work than if some products were not gaseous.

Additionally, because the compound of the invention is a compound, its detonation properties (i.e., its detonation velocity and pressure) can be predicted and will be greater than or equal to those of any mechanical mixture of AN and DETN having the same density as the compound of the invention.

The ingredients AN and DETN, from which the compound is prepared, are inexpensive. Furthermore, the compound forms eutectics with other explosive compounds (e.g., AN). The compound/AN eutectic has a processing temperature for casting of explosive items of above about 114° C. to below the temperature on the liquidus line corresponding to the particular compositin. This range is neither too high nor too low for practical applications. This means that the compound of the invention can be cast as a molten slurry at temperatures attainable by high pressure steam, and hence it is expected that it can be used in plants presently used to fill TNT based munitions. The processing temperature range can be lowered by the addition of other soluble materials such as ethylene diamine dinitrate. Additionally, the compound is quite insensitive, as shown by the results of impact tests described below. Furthermore, even if the compound dissociates (which occurs if the temperature of the compound falls below 46° C.), the dissociation product is itself a useful composition of matter since it is a fine-grained eutectic explosive.

The present invention also comprises, in accordance with its objects and purposes, explosive articles of manufacture formed from the compound of the invention and explosive articles of manufacture formed from the fine-grained eutectic of the invention.

BRIEF DESCRIPTION OF THE DRAWINGS

The accompanying drawings, which are incorporated in and form a part of the specification, illustrate various embodiments of the present invention and, together with the description, serve to explain the principles of the invention. In the drawings.

DESCRIPTION OF THE PREFERRED EMBODIMENTS

In the practice of the invention, the starting materials for preparing the new compound of the invention are AN (i.e., ammonium nitrate, $NH_4NO_3$) and DETN (i.e., di ethylenetriamine trinitrate, $[(NH_3CH_2CH_2)_2NH_2]^{+3}.(NO_3^-)_3$).

The starting material AN is commercially available in high purity form. However, DETN is not commercially available and must be prepared.

The preparation of DETN can be done in any of several ways. Two suitable ways are to react diethylene triamine with excess nitric acid and precipitate the salt by the addition of methanol, or to evaporate water from solutions of the salt. Other conventional means for isolating inorganic salts could be used.

Figure 1:
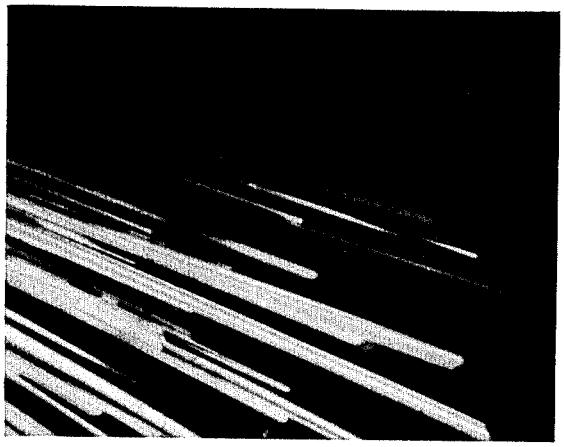
FIG. 1 is a photograph at a linear magnification of 105× of crystals of the compound of the invention and an adjacent region of molten AN/DETN mixture.

The compound of the invention can be prepared from AN and DETN in the following manner. Powders of AN and DETN are mixed in a particular molar ratio (described below), and the mixture is heated to a temperature which is sufficiently high to melt the AN/-DETN eutectic but which is below the temperature on the liquidus line corresponding to that composition on the phase diagram of AN/compound. If the temperature is above the AN/compound eutectic temperature, then the closer the temperature is to the AN/compound eutectic temperature, the greater is the driving force for compound formation. A temperature of about 114° C. is nearly optimum. Then the molten mixture is maintained at that temperature for a period of time sufficient to enable the compound of the invention to form. Getting the compound to form is not a trivial matter because the molar concentration of reactants must be appropriately selected as described below, the temperature at which the compound forms must be selected as described above, and the time period for its formation must also be sufficient. Therefore, others who have melted the reactants AN and DETN together might have formed the compound to some extent; but they would not necessarily have formed it to any extent. Applicants fortuitously noticed by using a microscope that crystals of the compound formed as they raised the temperature of a particular melted molar ratio of AN and DETN. The crystals that formed could not be AN or DETN because the AN and DETN had already melted; thus, they were recognized to be something new. To applicants' knowledge, nobody previously has made the compound of the invention. A photograph of crystals of the compound is shown in FIG. 1.

The compound of the invention has formed without seed crystals only within a quite narrow temperature and composition range. However, the compound is stable and will form slowly by growth from seeds over a much wider temperature and composition range. As seen on the phase diagram shown in FIG. 2, that temperature range of formation and observation is a maximum when the molar ratio of DETN:AN is about 35:65. At that molar ratio, the temperature range of formation of the compound is from about 114° C. to the temperature on the liquidus line. If others had made a melt of AN and DETN at that molar ratio, probably the temperature would not have been within that narrow range for a period of time sufficient to form the compound; and if the melt quickly cooled down through that narrow temperature range before recrystallization, then the crystals would have been a mixture of AN and DETN, not crystals of the compound of the invention, because AN and DETN recrystallize faster than the compound forms. This means that the temperature must be held within the narrow range of formation of the compound while the compound forms. However, as stated above, the temperature range at which the compound can exist (and be stable) after it has formed is broader than the range in which the compound can form quickly.

Figure 2:
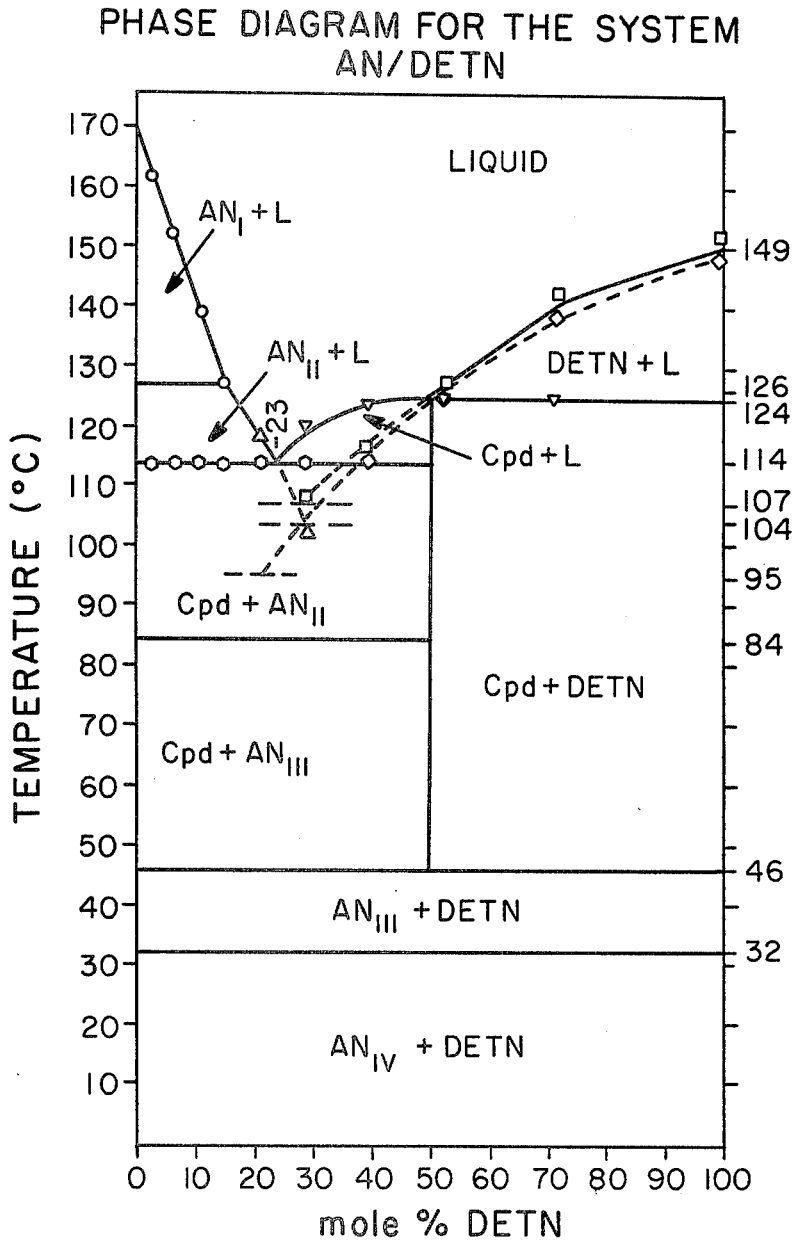
FIG. 2 is an experimentally determined phase diagram of the compound of the invention.

As shown on the phase diagram in FIG. 2, the compound can theoretically form when the molar ratio of DETN:AN is anywhere between 0 and 100% DETN; however, that does not imply ease of observation or formation. When that molar ratio is 50:50, the compound forms within the range from about 114° to 124° C., and at temperatures up to 124° C., only crystals of compound (without melt) are present. However, as mentioned above, when the molar ratio of DETN:AN is about 35:65, the formation of the crystals of the compound of the invention can be most easily observed because the temperature range where only compound and melt exist is largest at that molar ratio.

Of the attempts at forming the crystals of the compound of the invention from 35:65 mixtures on a microscope slide, in 9 out of 10 runs, the long, needle-shaped crystals of the compound of the invention formed. In the one unsuccessful run, the fact that the crystals of the compound of the invention did not form is not understood at this time because it is believed that the same procedure was carried out for all of the 10 runs.

Once the crystals have formed, they can be used, if desired, as seed crystals to ensure the formation of the compound and to ease its formation in other AN/-DETN mixtures. The addition of such seed crystals to a mixture of AN and DETN at a temperature between 46° C. and 114° C. will eventually lead to a mixture of the compound and either AN or DETN, whichever is in excess. The rate of the conversion is faster at temperatures above the AN/DETN eutectic temperature (i.e., above 107° C.) than at lower temperatures.

It is believed that small amounts of impurities can be present in the AN and DETN and will not adversely affect the formation of the compound of the invention.

One alternate (although not preferred) method for preparing the compound of the invention is to add nitric acid to a mixture of the triamine and perchloroethylene, then to add ammonium nitrate, then to heat to distill off the water which formed, and then finally to add seed crystals of the compound to ensure its formation.

Another method of preparation is to evaporate an aqueous solution of AN and DETN at temperatures above 46° C. Addition of seed crystals of compound helps initiate its crystallization. Similarly, an excess of AN helps overcome the high solubility of AN.

When the compound was subjected to an impact test, described in Example 4 below, it was found to be relatively insensitive; but it is clearly an explosive.

Another identifying characteristic of the compound of the invention (as discussed above) is that the compound is thermodynamically unstable with respect to AN and DETN and decomposes to the starting materials when the compound is not maintained at a temperature above 46° C. This decomposition takes place rather slowly. The factors that control the rate of this transformation are very complex, and it is not possible to predict the degree of dissociation as a function of temperature alone. At room temperature the conversion requires a period of days.

Figure 3:
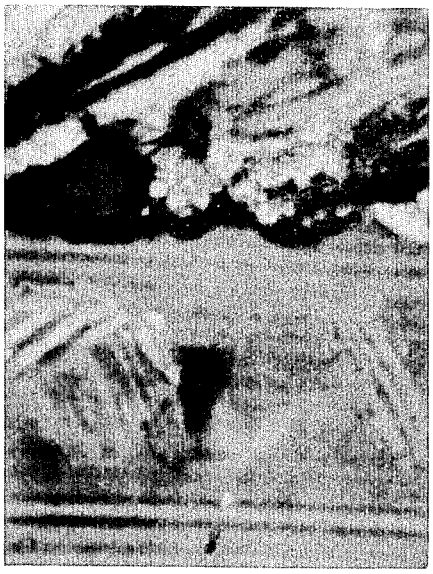
FIG. 3 is a photograph at a magnification of 338× of a crystal of the compound of the invention and some AN/compound eutectic.
Figure 4:
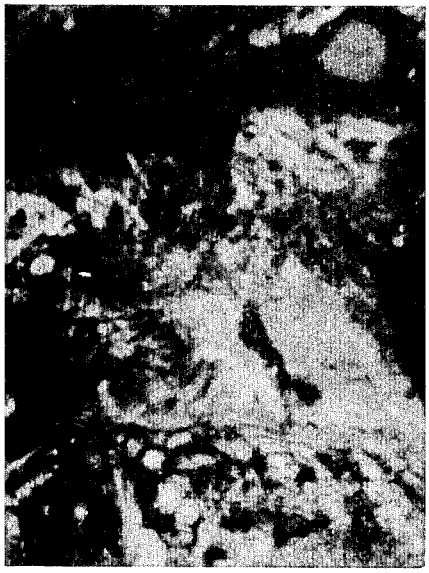
FIG. 4 is a photograph at a magnification of 338× of the same region as FIG. 3 which shows the fine-grained eutectic composition of the invention which formed when the compound of the invention decomposed below 46° C., specifically in this case at 22° C. Note that it is very difficult to distinguish individual crystals of AN or DETN because they are so small. The lower parts of FIGS. 3 and 4 show the conversion of the compound of the invention to its pseudomorph, described below.
Figure 5:
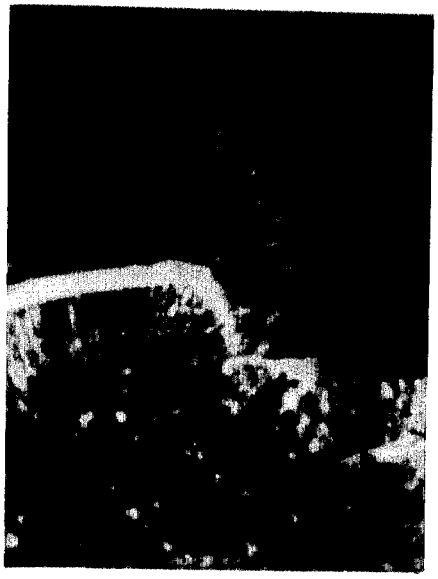
FIG. 5 is a photograph at a magnification of 338× of crystals of AN and DETN grown from a melt (i.e., prior art), rather than by decomposition of the compound of the invention. These crystals appear to be about ten times the size of those in FIG. 4. There is also a region of melt at the top of this photograph.

The decomposition product, as discussed above, is a fine-grained composition of matter of AN and DETN in the form of a pseudomorph of the original compound. That is, the original compound decomposes to a mixture of fine crystals of AN and DETN in a form which retains the shape of the original crystal of compound; and this behavior characterizes the compound. This can be seen in a comparison of the lower parts of FIGS. 3 and 4. The grain size of the decomposition product (shown in FIG. 4) appears to be about one-tenth the size of that formed in normal recrystallization (shown in FIG. 5). For explosives, the important size parameter is the minimum diffusion distance for complete mixing during detonation.

The phase diagram was experimentally obtained by using accepted standard techniques, as are described for example in *Fusion Methods in Chemical Microscopy*, W. C. McCrone, Interscience Publishers, Inc.:NY, 1957 at pp. 2–4 and 132–172. That reference is hereby incorporated herein by reference.

The formula of the compound of the invention was determined as part of the phase diagram determination. If one forms the compound from a 50:50 molar ratio mixture of AN and DETN, there is no evidence for an excess of either AN or DETN as a separate phase between 46° C. and 124° C.; and this finding is the proof that the formula of the compound is $$NH_4^+ . [(NH_3CH_2CH_2)_2NH_2]^{+3} . (NO_3^-)_4$$

This is further described in Example 3 below.

Shown in Table I below are the X-ray diffraction patterns of a mixture of the compound of the invention, AN and DETN; the pattern of pure AN (polymorph IV); the pattern of pure DETN; and a pattern of the pure compound obtained at 115° C. There is some error in the values which are given in Table I because the values were obtained from films and standard transparent "d" scales. The reading errors when converted to millimeters on films from 114.5 mm-diameter cameras should not exceed 0.5 mm. The 115° C. pattern was obtained on a modified precession camera on a flat film. Single crystal precession photographs have also been obtained, but the correspondence between spots of known index and the powder pattern has not as yet been made. It is believed that the pattern given in the table for the mixture of the compound and AN and DETN is accurate enough so that the compound of the invention can be identified from that diffraction pattern.

TABLE I

X-ray patterns of Compound, AN, and DETN using the methods described in Example 3.

| COMPOUND (+AN and DETN) | | $AN_{IV}$ | | DETN | | COMPOUND 115° C. | |
|---|---|---|---|---|---|---|---|
| d | I | d | I | d | I | d | I |
| 8.40 | VW | | | 8.35 | M-W | 8.47 | VVW |
| 7.40 | VVW | | | | | 7.25 | VVW |
| 5.90 | VW | | | | | 5.89 | W |
| 5.25 | M | | | | | 5.26 | M |
| 5.08 | VVW | | | 5.10 | W | | |
| 4.90 | W | 4.93 | M | | | | |
| 4.72 | VW | | | 4.70 | M | 4.72 | VVW |
| 4.53 | S | | | | | 4.52 | M-S |
| 4.37 | S | | | | | 4.38 | S |
| 4.17 | W | | | 4.17 | S | 4.21 | VW |
| 4.00 | M | 3.95 | S | | | 3.97 | W |
| 3.86 | W | | | | | 3.88 | W |
| 3.75 | M-S | | | 3.73 | M | 3.73 | M |
| | | | | 3.69 | M | | |
| 3.64 | M-S | 3.65 | VW | | | 3.61 | M-S |
| 3.55 | VW | | | | | | |
| 3.48 | M | | | 3.49 | VS | 3.48 | M |
| 3.40 | VS | | | | | 3.40 | S |
| 3.31 | M | | | | | 3.32 | M-S |
| 3.29 | W | | | | | | |
| 3.19 | M | | | 3.19 | VW | 3.20 | M |
| 3.10 | W | | | | | | |
| 3.09 | VS | 3.08 | VS | 3.09 | M | 3.07 | VS |
| 2.98 | W | | | 2.96 | W | 2.97 | M |
| 2.95 | W | | | 2.94 | M | | |
| 2.87 | VW | 2.87 | W | | | | |
| 2.84 | W | | | 2.82 | W | 2.85 | VW |
| 2.77 | W | | | | | 2.78 | W |
| 2.72 | VW | 2.72 | S | | | | |
| 2.70 | VW | | | 2.69 | W | 2.69 | W |
| 2.62 | W | | | 2.63 | W | 2.63 | W |
| | | | | 2.58 | W | | |
| 2.54 | VW | | | 2.54 | W | | |
| 2.50 | W | 2.48 | W | | | 2.51 | M |
| 2.45 | VVW | | | 2.44 | M | | |
| 2.40 | M-W | 2.38 | W | 2.39 | VW | 2.41 | M |
| 2.34 | VVW | | | 2.33 | W | | |
| 2.30 | VW | | | 2.31 | VVW | 2.30 | VW |
| 2.26 | W | 2.25 | S | 2.27 | W | 2.27 | VVW |
| 2.23 | VVW | | | 2.25 | VVW | | |
| 2.18 | W | | | 2.18 | VVW | 2.18 | W |
| 2.13 | W | | | 2.12 | VVW | 2.13 | W |

V = Very,
W = Weak,
M = Medium,
S = Strong
I = Intensity,
d = interplanar spacing in Å

Another characteristic of the compound of the invention is that the compound crystallizes in space group $p2_1/c$, with a = 10.48 Å, b = 14.43 Å, c = 14.20 Å, and $\beta$ = 134.3°, wherein these parameters are defined in *International Tables for X-Ray Crystallography,* vol. 1, The Kynoch Press; Birmingham, England, 1952, and in F. Donald Bloss *Crystallography and Crystal Chemistry,* Holt, Rinehart and Winston, Inc.:New York, 1971 at pp. 162 -174, which is hereby incorporated herein by reference. Using the measured parameters, assuming 4 molecules per unit cell, and using the method described in F. Donald Bloss, cited above, at pp. 347-348, (which is hereby incorporated by reference), the crystal density was calculated to be 1.61 g/cm$^3$.

The density of the compound of the invention has been measured to be about 1.53 g/cm$^3$ by liquid displacement. This is described in Example 5 below. It is believed that this number is low because of possible trapped bubbles in the preparation.

Although the compound of the invention is not stable at temperatures below 46° C., it is believed that it might be possible to stabilize the compound to room temperature by introducing a small amount of potassium ion into the compound. Using some potassium ion instead of ammonium ion may well change the physical properties of the compound of the invention so that it is stable at room temperature. This belief is based on the operation of potassium ion in ammonium nitrate where the addition of 15% by weight potassium nitrate changes the stability range of $AN_{III}$ from 32° to 84° C. to −15° to 110° C.

The compound of the invention has been shown to be an explosive material by the impact sensitivity test described in Example 4 below. It is expected that the compound of the invention can be used in conventional explosive applications by using conventional explosive techniques. However, as is well known in the art of explosives, no explosive material should be put into routine use until sufficient safety tests are done on the material; and neither this compound nor eutectic mixtures of AN and DETN have been fully evaluated.

The fine-grained eutectic composition formed when the compound of the invention dissociates at temperatures below 46° C. is a useful explosive material and will be a finer grained eutectic mixture of AN and DETN than can be obtained by any other known method.

EXAMPLES

In the following examples, AN and DETN were mixed together in various molar proportions. The AN was obtained from Mallinkrodt Company, and its stated purity was greater than 99.5%.

The DETN was prepared as follows: 50 ml of diethylene triamine (Eastman Kodak Company #4573) was mixed with 30 ml deionized water in a 3 liter flask equipped with a stirrer, thermometer, and dropping funnel. While cooling with an ice bath to keep the mixture at ambient temperature, 87.46 ml of 70% nitric acid was added. Methanol was then added dropwise (200-400 ml) to precipitate DETN. The white solid was collected by filtration, washed with methanol, and then dried. The chemical composition of DETN was determined by elemental analysis.

EXAMPLE 1

In this example, a 29:71 molar mixture of DETN:AN was prepared on a microscope slide; and the temperature was raised gradually. At about 107° C., the mix melted; and as the temperature was raised further, long, needle-shaped crystals (shown in FIG. 1) were observed to form when the temperature was within the range from about 110° to about 118° C. This anamolous formation of crystals from the melt was a signal that a new compound may have been forming. As described below, subsequent tests showed that this was indeed the case.

EXAMPLE 2

In this example, many runs were made on mixtures of known composition in order to establish the phase diagram shown in FIG. 2. The circles are the experimentally determined liquidus points where $AN_I$ was the final crystalline phase. Triangles are liquidus points where $AN_{II}$ was the final crystalline phase. Squares are liquidus points for the stable form of DETN, and diamonds are the liquidus points for a less stable form of DETN. This less stable form of DETN does not necessarily seem to be a distinct polymorph, but it may instead be a strained or disordered form that crystallizes from supercooled melts. Inverted triangles are the experimentally determined liquidus points or incongruent melting points for the compound. Hexagons are observed eutectic melting points in the $AN_{II}$/compound region. Dashed lines are liquidus lines for unstable phases. These dashed lines are only observable because of the slowness at which stable phases in this system crystallize from the melt. Therefore, the compound is stable and theoretically present to some degree for all compositions between pure AN and pure DETN at temperatures above 46° but below 114° C. The compound is also stable in the region between 114° C. and 124° C. where there is an excess of DETN. The compound is also stable in the region between 23 and 50 mole % DETN at temperatures above 114° C., but below the liquidus temperature for the particular composition.

EXAMPLE 3

In this example, a 50:50 molar mixture of AN:DETN was mixed and then melted. When the compound formed from this 50:50 molar ratio of AN and DETN, there was no evidence for an excess of either AN or DETN as a separate phase between 46° and 124° C. This fact together with the fact that there was no evidence of a change in ionic species (i.e., there was no significant amount of gas formed, there was no change in color, and there was no other evidence for chemical reaction) and the fact that the compound of the invention dissociates to form the two starting materials establishes that the formula of the compound of the invention is:

$$NH_4^+.[(NH_3CH_2CH_2)_2NH_2]^{+3}.(NO_3^-)_4.$$

The two starting materials reacted essentially completely at this molar ratio (as determined visually through the microscope) to form long, needle-like crystals at a temperature (122° C.) where there was only a small amount of crystalline DETN and a large amount of AN/DETN molten solution initially. These crystals of the compound of the invention were then scraped off the microscope slide; there was no need to isolate the crystals from anything because they were the only crystals visible on the slide. Their X-ray diffraction pattern was next measured as described below.

The technique which was used to obtain the X-ray diffraction pattern of the compound of the invention is disclosed in Harold P. Klug et al., *X-ray Diffraction Procedures for Polycrystalline and Amorphous Materials,* 2nd ed., Wiley and Sons: New York, 1974, pages 175–222; and on pages 419–434 of that reference, the method used for interpretation of the powder diffraction data is given. Those portions of that reference are hereby incorporated herein by reference. The Debye-Scherrer method there described was used. A Debye-Scherrer X-ray camera obtained from Philips Electronics Instruments having type no. 52056/0 was used. The sample was ground and screened in order to prepare a powder which would pass through a 200—mesh screen. The powder was mounted in a glass capillary having internal diameter of 0.3 mm. The type of radiation which was used was Cuκα (λ=1.542Å), rendered free of β radiation by transmission through a strip of Ni foil. The X-ray film which was used was Eastman Kodak No Screen.

The X-ray diffraction pattern raw data was used to measure d spacings in a single step by the use of scales constructed to read in d spacings directly (as described on pages 431–434 of the Klug reference cited above). The X-ray diffraction pattern so obtained is given above in Table I.

It is possible to eliminate the patterns of AN and DETN by measuring the X-ray diffraction pattern under conditions where these materials cannot be present in crystalline form, and this has been done. A Charles Supper Precession camera was modified so that the sample could be rotated slowly and the camera used as a flat plate powder camera. The sample temperature was controlled with a heated stream of flowing $N_2$ gas supplied by a modified Enraf Nonius "Universal Low Temperature Device for X-Ray Diffraction Cameras." The film plane was 40 mm from the sample axis. Cuκα x-rays were again used to obtain front reflection data. The diffraction pattern obtained for the compound at 115° C. with this apparatus is given in Table I. The sample was initially a 31.5:68.5 molar mixture of DETN:AN. This temperature is above the temperature at which the eutectic with AN melts, and the sample had an excess of AN; therefore, the crystalline material could only be the 1:1 compound.

Single crystal diffraction patterns also have been obtained on the compound at room temperature. This experiment is described in more detail in Example 5.

EXAMPLE 4

In this example, a sample of compound formed from a 31.5:68.5 molar ratio of DETN:AN was subjected to an impact test. The impact sensitivity of the compound of the invention was measured on an ERL model impact machine with type 12A and 12B tools by a procedure which is fully described in the "Encyclopedia of Explosives and Related Materials," Vol. 7, pages I–35 through I–55, PATR 2700, 1975; and that reference is hereby incorporated herein by reference. Two series of tests were run, one in which fine sandpaper was placed under the explosive layer and another in which no sandpaper was used, the former test being referred to as a type 12A test and the latter being referred to as a type 12B test. The tests were the so-called "Bruceton" or "up and down" or "stair-case" test for obtaining the so-called 50% height (i.e., the height of drop for which one-half of the trials are "go" and one-half of the trials are "no-go"). In each of the two series of tests, 25 drops were made, the sample size for each individual drop having been 40 mg. For the type 12A impact sensitivity test (in which a sample was placed in a dimple in the sandpaper and in which a 2 kg falling weight was used), the 50% height of the compound of the invention was found to be 150 cm. However, for that same height on the type 12B test, the test results were "no-go" at a 320 cm drop. From the results of these tests, one can validly conclude that the sample is a moderately insensitive explosive.

EXAMPLE 5

In this example, samples of compound formed from a 31.5:68.5 molar ratio of DETN:AN were subjected to density tests. Sample volumes were obtained by displacement of a measured weight of benzene from a known volume pycnometer. Corrections were applied assuming the ammonium nitrate was polymorph IV. The density of the compound was measured to be greater than 1.53 g/cm$^3$ by this technique.

In another test, single crystals were prepared for X-ray diffraction experiments by separating them from 31.5:68.5 molar ratio melts at about 120° C. Crystals have to be separated from excess melt at the growing temperature, but they can then be cooled and studied at room temperature. Conventional X-ray diffraction photographs were obtained with a Buerger precession camera to determine the following crystallographic properties for the compound:

| | |
|---|---|
| Space group: | $P2_1/c$ |
| Lattice parameters: | a = 10.48 Å |
| | b = 14.43 Å |
| | c = 14.20 Å |
| | $\beta$ = 134.3° |
| Density (assuming 4 molecules/cell) $\rho$ = 1.61 g/cm$^3$. | |

This X-ray density is believed to be the true density for the compound because it is not subject to the experimental errors associated with the displacement density. All crystals separated from the melt were twins which were twinned on the 011 plane.

The foregoing description of preferred embodiments of the invention has been presented for purposes of illustration and description. It is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An explosive composition comprising the equimolar double salt of ammonium nitrate and diethylenetriamine trinitrate, said composition having a density of about 1.61 g/cm$^3$ and being characterized by an X-ray diffraction pattern as shown in the right-hand column of Table I labeled Compound/115° C.

2. A method of making an explosive double salt of ammonium nitrate and diethylenetriamine trinitrate, the double salt having a density of about 1.61 g/cm$^3$ and being characterized by an X-ray diffraction pattern as shown in the right-hand column of Table I labeled Compound/115° C., comprising the steps of:

(a) forming a mixture of diethylenetriamine trinitrate and ammonium nitrate, said mixture containing between 23 and 50 mole percent diethylenetriamine trinitrate;

(b) heating said mixture to a first temperature of between approximately 107 and 124 degrees Celsius;

(c) maintaining said mixture at said first temperature for a time sufficient to allow said ammonium nitrate and diethylenetriamine trinitrate to crystallize as a double salt; and (d) thereafter cooling said double salt to a second temperature above 46 degrees Celsius and below approximately 107 degrees Celsius.

3. The method defined in claim 2 wherein said first temperature is approximately 114 degrees Celsius.

* * * * *